US010737505B2

(12) United States Patent
Hachmann

(10) Patent No.: US 10,737,505 B2
(45) Date of Patent: Aug. 11, 2020

(54) METHOD FOR ALTERNATELY OPERATING AN INKJET PRINTING MACHINE

(71) Applicant: HEIDELBERGER DRUCKMASCHINEN AG, Heidelberg (DE)

(72) Inventor: Peter Hachmann, Weinheim-Hohensachsen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/262,070

(22) Filed: Jan. 30, 2019

(65) Prior Publication Data

US 2019/0255857 A1 Aug. 22, 2019

(30) Foreign Application Priority Data

Feb. 19, 2018 (EP) ..... 18157352

(51) Int. Cl.
*B41J 2/21* (2006.01)
*B41J 2/045* (2006.01)
*B41J 2/505* (2006.01)

(52) U.S. Cl.
CPC ..... *B41J 2/2103* (2013.01); *B41J 2/04551* (2013.01); *B41J 2/04586* (2013.01); *B41J 2/21* (2013.01); *B41J 2/2107* (2013.01); *B41J 2/2132* (2013.01); *B41J 2/2146* (2013.01); *B41J 2/5056* (2013.01)

(58) Field of Classification Search
CPC ..... B41J 2/2103; B41J 2/2132; B41J 2/2107; B41J 2/21; B41J 2/04551; B41J 2/04586; B41J 2/5056; B41J 2/2146
See application file for complete search history.

(56) References Cited

U.S. PATENT DOCUMENTS 4,800,403 A 1/1989 Accattino et al.
6,367,912 B1 * 4/2002 Kishimoto ..... B41J 2/145 347/40

(Continued)

FOREIGN PATENT DOCUMENTS

EP 0373957 A1 6/1990
JP H0226753 A 1/1990

(Continued)

*Primary Examiner* — Sharon A. Polk
(74) *Attorney, Agent, or Firm* — Laurence A. Greenberg; Werner H. Stemer; Ralph E. Locher

(57) ABSTRACT

A method for alternately operating an inkjet printing machine applying a plurality of inks to a printing material in accordance with a print image, includes conveying the printing material at a conveying speed. A switch is made between the following two modes, a 1$^{st}$ mode of printing an n-color first print job at a first conveying speed and at a print resolution using n inks, i.e. using black ink and n−1 different chromatic inks; and a 2$^{nd}$ mode of printing a reduced-color second print job at a second conveying speed greater than the first conveying speed and at the same print resolution using the n inks. The printing speed and thus the number of prints produced per unit of time in a machine can therefore advantageously be increased.

2 Claims, 6 Drawing Sheets

(56) References Cited

U.S. PATENT DOCUMENTS

| | | | | |
|---|---|---|---|---|
| 2008/0074454 | A1* | 3/2008 | Campbell | B41J 2/5056 347/15 |
| 2009/0051734 | A1* | 2/2009 | Ike | B41J 2/2107 347/43 |
| 2009/0058910 | A1 | 3/2009 | Hatanaka et al. | |
| 2009/0322842 | A1* | 12/2009 | Kosydar | C09D 11/322 347/100 |

FOREIGN PATENT DOCUMENTS

| | | | |
|---|---|---|---|
| JP | 2652405 | B2 | 10/1997 |
| JP | H10291329 | A | 4/1998 |
| JP | 2010186768 | A | 8/2010 |

* cited by examiner

METHOD FOR ALTERNATELY OPERATING AN INKJET PRINTING MACHINE

CROSS-REFERENCE TO RELATED APPLICATION

This application claims the priority, under 35 U.S.C. § 119, of European Patent Application EP 18 157 352.8, filed Feb. 19, 2018; the prior application is herewith incorporated by reference in its entirety.

BACKGROUND OF THE INVENTION

Field of the Invention

The invention relates to a method for alternately operating an inkjet printing machine applying a plurality of inks to a printing material in accordance with a print image.

The technical field of the invention is the graphic industry, in particular the field of industrial inkjet printing on flat substrates, i.e. the application of liquid ink to sheet or web-shaped printing material, preferably made of paper, paperboard, cardboard, or plastic.

Description of the Related Art

Heidelberger Druckmaschinen AG of Heidelberg, Germany has developed an inkjet printing machine for industrial production. That machine is marketed under the name "Primefire." It prints water-based inkjet inks onto sheets of paper. The machine includes seven successive printing stations that transfer the colors CMYK (cyan, magenta, yellow, and black) and OGV (orange, green, violet) to the paper by using print heads. The applied inks are dried by using IR driers.

In regular operation, the printing speed of that machine and of similar machinery is limited by the cycle of the print heads.

European Patent Application EP 373 957 A1, corresponding to U.S. Pat. No. 4,908,638, discloses an inkjet printing device that optionally prints at a fourfold speed. For that purpose, the print heads are supplied with black ink (K) instead of chromatic ink (CMY).

Japanese Publication JP 10-186768 A discloses an electrophotographic printing device that likewise optionally prints at a fourfold speed. For that purpose, printing units for chromatic inks (CMY) are exchanged for printing units for black (K).

Increasing the printing speed without complex and time-consuming change-over operations would be desirable.

SUMMARY OF THE INVENTION

It is accordingly an object of the invention to provide a method for alternately operating an inkjet printing machine, which overcomes the hereinafore-mentioned disadvantages of the heretofore-known methods of this general type and which improves the prior art in such a way, in particular, as to allow the printing speed and consequently the number of printed products produced per unit of time in a machine to be increased—at least for selected print jobs—in a simple way and without change-over measures in terms of the supply of ink or the print heads.

With the foregoing and other objects in view there is provided, in accordance with the invention, a method for alternately operating an inkjet printing machine applying a plurality of inks to a printing material in accordance with a print image, which comprises conveying the printing material at a conveying speed, and carrying out a switch between the following two modes:

- a $1^{st}$ mode: printing an n-color first print job at a first conveying speed and at a print resolution using n inks, i.e. using black ink and n−1 different chromatic inks; and
- a $2^{nd}$ mode: printing a reduced-color second print job at a second conveying speed greater than the first conveying speed and at the same print resolution using the n inks.

The invention advantageously allows the printing speed and thus the number of prints produced per unit of time in a machine to be increased—at least for selected print jobs printed in the $2^{nd}$ mode—in a simple way, in particular without any change-over measures in terms of ink supply or print heads.

Thus, the invention advantageously allows in particular monochrome print jobs (such as black, black-and-white, or grayscale print jobs) to be processed at a higher printing material conveying speed and thus at a higher printing speed. Despite the increased speed, the print resolution is not reduced, i.e. the quality of the prints remains the same.

In other words, in accordance with the invention, a multicolor printing machine may be operated as such in a $1^{st}$ mode and alternately as a faster monochrome printing machine in a $2^{nd}$ mode. The machine is switched between the two modes depending on the pending print job (multicolor or monochrome). For example, in the $1^{st}$ mode, the machine may produce 3000 7-color prints per hour and in the $2^{nd}$ mode, the machine may print 12000 black-and-white prints per hour.

"Printing material" may be understood to be paper, paperboard, cardboard, corrugated board, or plastic film, preferably in sheet form.

Another preferred development of the method of the invention may be that in the $2^{nd}$ mode, a black-and-white or a grayscale print job is printed.

A further preferred development of the method of the invention may be that a proportion of black or gray elements of the print is printed by using the n−1 different chromatic inks. The elements may be composite print dots of the print.

An added preferred development of the invention may be that n=7 and the following K CMY OGV inks are applied: black, i.e. K, cyan, i.e. C, magenta, i.e. M, yellow, i.e. Y, orange, i.e. O, green i.e. G, and violet, i.e. V.

Black or gray/grayscales may preferably be composed as follows: OC, GM or VY.

Instead of OGV, other combinations of three colors may be used: Preferably such colors F1, F2, and F3 are used that are better approximations of black or gray/grayscales in combination with CMY than OGV: F1C, F2M F3Y.

An additional preferred development of the invention may be that substantially three quarters of the black or gray/grayscale elements of the print are printed using OC, GM, or VY inks (or alternatively: F1C, F2M, F3Y).

Another preferred development of the invention may be that the second conveying speed is substantially a fourfold of the first conveying speed.

A further preferred development of the invention may be that n=4 and the following K CMY inks are applied: black, i.e. K, cyan, i.e. C, magenta, i.e. M, and yellow, i.e. Y.

Black or gray/grayscales may preferably be composed as follows: CMY.

An added preferred development of the invention may be that substantially half of the black or gray/grayscale elements of the print are printed by using CMY inks.

A concomitant preferred development of the invention may be that the second conveying speed is substantially twice the first conveying speed.

The features of the invention, of further developments of the invention, and of the exemplary embodiments of the invention may be combined with one another in any desired way, resulting in creating advantageous further developments of the invention. In addition, further developments of the invention may include the individual features or combinations of features disclosed in the above section entitled "Field of the Invention."

The invention as well as the preferred further developments thereof will be explained in more detail below with reference to the drawings and based on a preferred exemplary embodiment.

Other features which are considered as characteristic for the invention are set forth in the appended claims.

Although the invention is illustrated and described herein as embodied in a method for alternately operating an inkjet printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
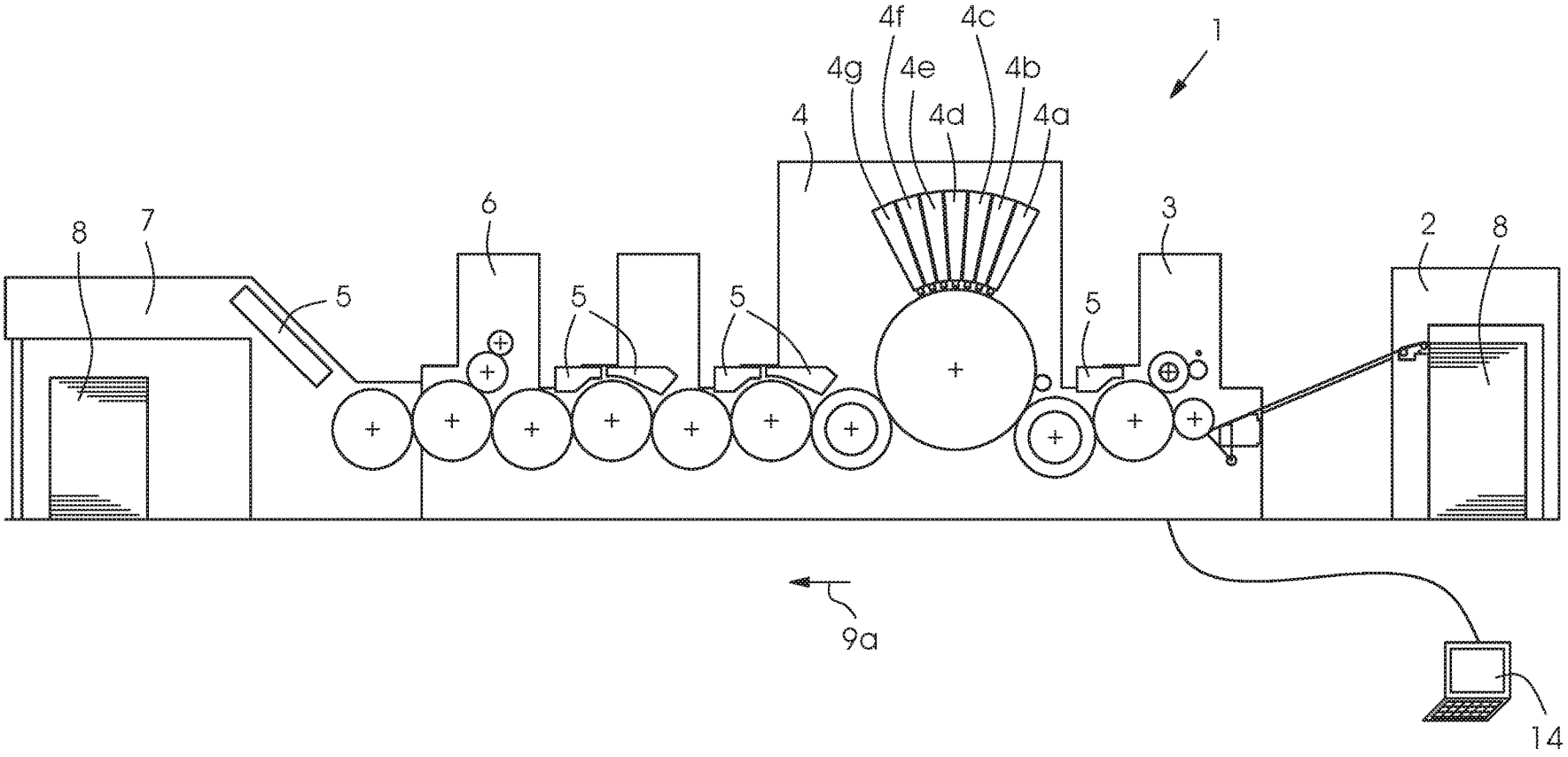
FIG. 1 is a diagrammatic, longitudinal-sectional view of a machine implementing a method of the invention.

Referring now in detail to the figures of the drawings, in which corresponding elements have the same reference symbols, and first, particularly, to FIG. 1 thereof, there is seen an industrial production inkjet printing machine 1 processing sheets to produce monochrome or multicolor printed products in an inkjet printing operation. The machine 1 is shown as it is implementing the method of the invention. The prints are produced at a specified print resolution of 1,200×1,200 dpi.

The machine 1 includes a stack feeder 2, a pre-coating unit 3 for applying a precoat, an inkjet printing unit 4 for printing on sheets 8 in accordance with an image, one or more driers 5, a varnishing unit 6, and a stack delivery 7. The sheets 8 are conveyed through the machine by cylinders and are preferably made of paper, alternatively of cardboard.

The printing unit 4 includes seven printing stations 4*a* to 4*g* that succeed one another and transfer ink drops, preferably in process colors K CMY OGV (black, cyan, magenta, yellow, orange, green, and violet). Every station includes an assembly of print heads that is oriented to be substantially perpendicular to a conveying direction. The print heads are stationary during the printing operation and include a plurality of individually controllable printing nozzles for generating the drops ("drop on demand", DOD).

The stations 4*a* to 4*g* allow one side of a sheet to be printed on over its entire width in a so-called single pass operation, i.e. the sheet sides are moved into the effective region of the units only once. The inks are water-based inks having drops which react with the precoat to create print dots of high dot sharpness. They contain pigments as colorants.

The driers 5 are preferably thermal driers with infrared lamps, preferably LED lamps, that act to evaporate humidity from the applied ink, precoat and varnish and from the printing material.

The sheets 8 receive the print while they are being conveyed through the machine 1 in a direction 9*a* at a conveying speed.

The machine 1 further includes a machine control unit 14 including a computer and a control program running on the computer. The computer may be part of a non-illustrated control console. A device for supplying inks to the printing stations and a device for cleaning the print heads are likewise provided but not illustrated.

In accordance with the invention, the machine 1 may alternately be operated in a $1^{st}$ mode and in a $2^{nd}$ mode. The switch may be implemented by the control unit 14.

Figure 2A:
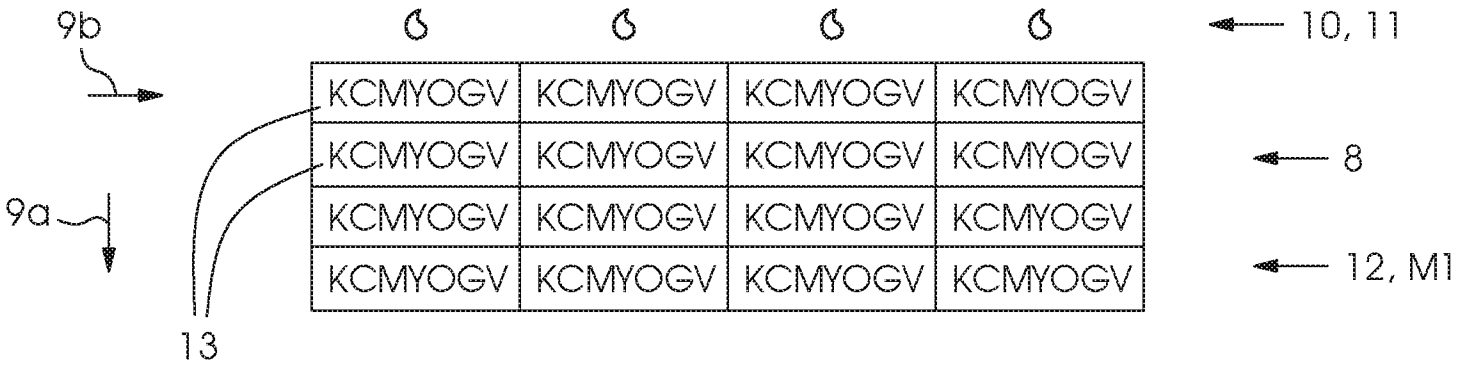
FIG. 2A is a plan view of a section of a seven-color print printed in the $1^{st}$ mode.

FIG. 2A illustrates an exemplary embodiment of the invention, in this case a section of two times four elements 13 of a print 12 printed in accordance with the invention. The print is created on the printing material 8, in the present case paper sheets, by applying ink 10 in the form of drops 11 of a specific size. The same applies to FIGS. 2B, 3A to 3C, and 4.

The elements 13 in the rows of the illustrated section (i.e. in the lateral direction 9*b*) are generated by adjacent nozzles of a print head (or multiple print heads for different colors succeeding one another in the conveying direction 9*a*). Every element is formed of one or more colors, i.e. of ink drops 11 of the corresponding color, which generate print dots of a corresponding color on the sheet 8. The print dots may be located next to one another or there may be a partial or total overlap between them. The elements 13 in the columns of the illustrated section (i.e. in the conveying direction 9*a*) are generated in accordance with the cycle of the print head or of the multiple print heads. Again, the same applies to FIGS. 2B, 3A to 3C, and 4.

FIG. 2A illustrates a section of a print 12 generated in a first mode M1 of the method of the invention: every element (i.e. every halftone dot) may be composed of multiple colors, i.e. of the corresponding inks 10. In the illustrated example, there are seven colors K CMY OGV. Thus, by way of example, a seven-color print is produced. The (average) conveying speed of the printing material attained in this process will be referred to as the standard speed in the following paragraphs. The printing operation is carried out on the machine 1 shown in FIG. 1, for instance.

Figure 2B:
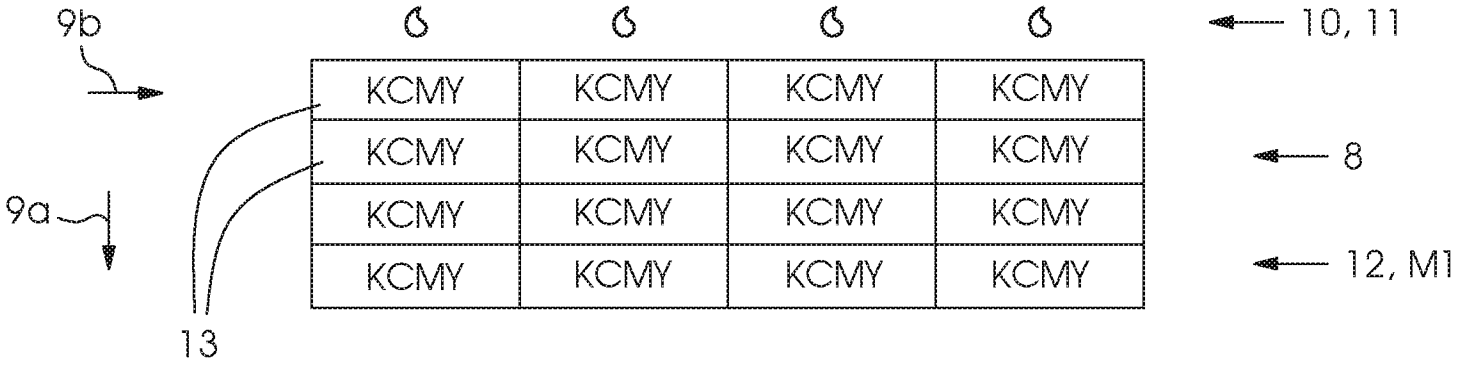
FIG. 2B is a plan view of a section of a four-color print printed in the $1^{st}$ mode.

In a way similar to FIG. 2A, FIG. 2B illustrates a section of a color print that has been printed in the first mode 1, but in the illustrated example only using the four colors K CMY. They are printed by a machine 1 corresponding to the one in FIG. 1, for example, but with only four printing stations 4*a* to 4*d* and at a standard speed attainable with this type of four-color printing machine.

Figure 3A:
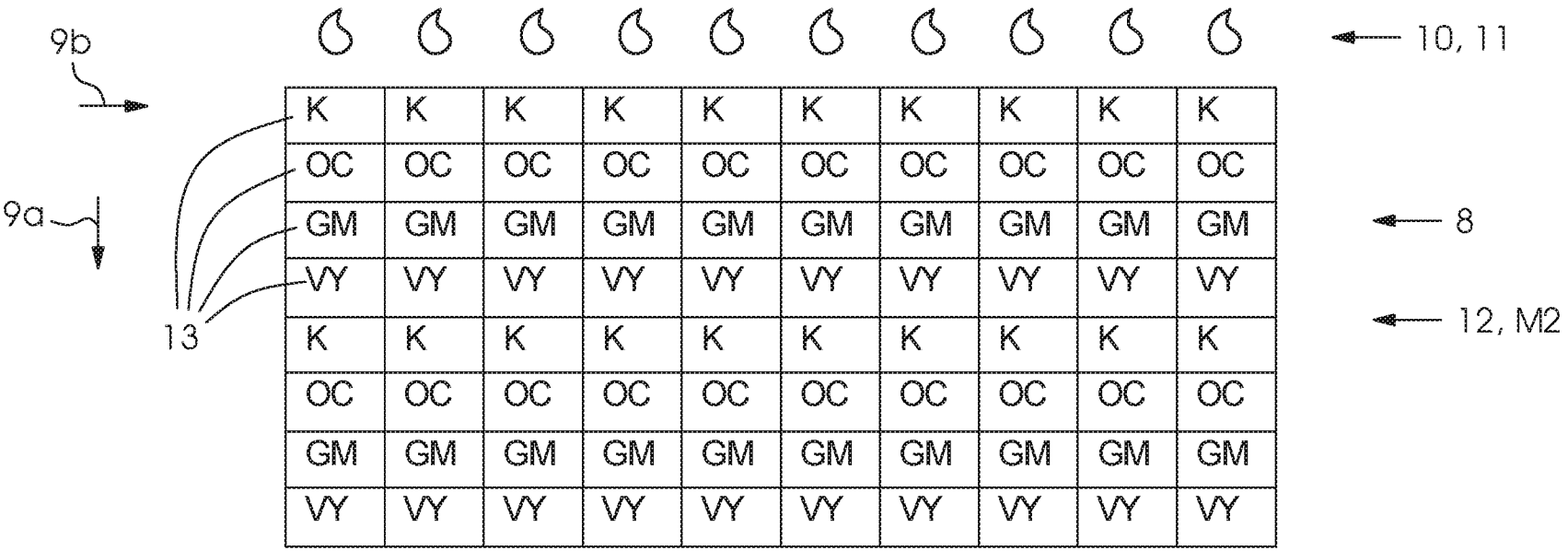
FIG. 3A is a plan view of a section of a seven-color print printed in the $2^{nd}$ mode.
Figure 3B:
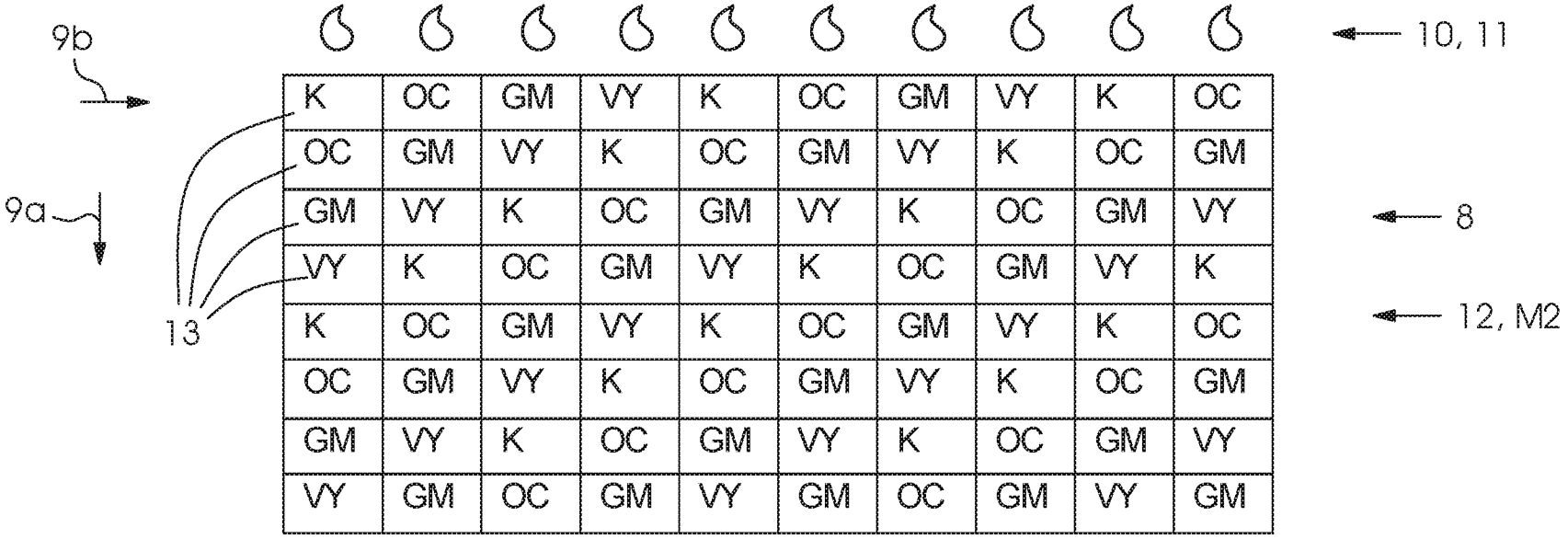
FIG. 3B is a plan view of a section of a seven-color print printed in the $2^{nd}$ mode.
Figure 3C:
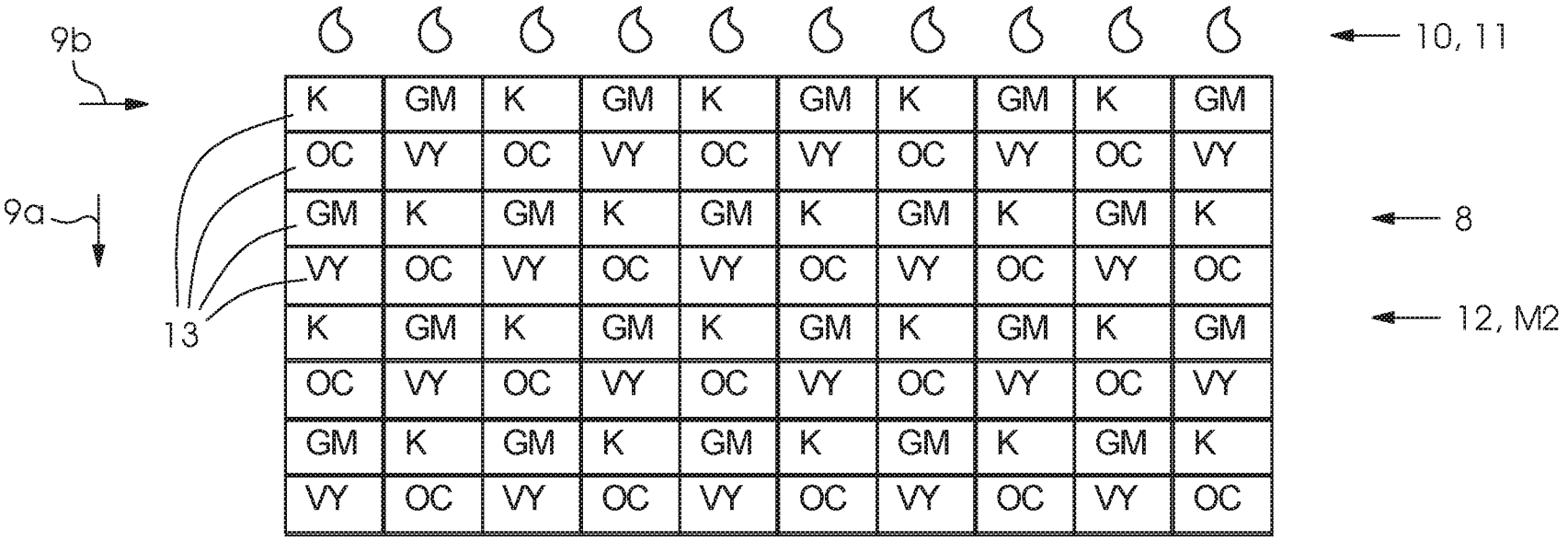
FIG. 3C is a plan view of a section of a seven-color print printed in the $2^{nd}$ mode.
Figure 4:
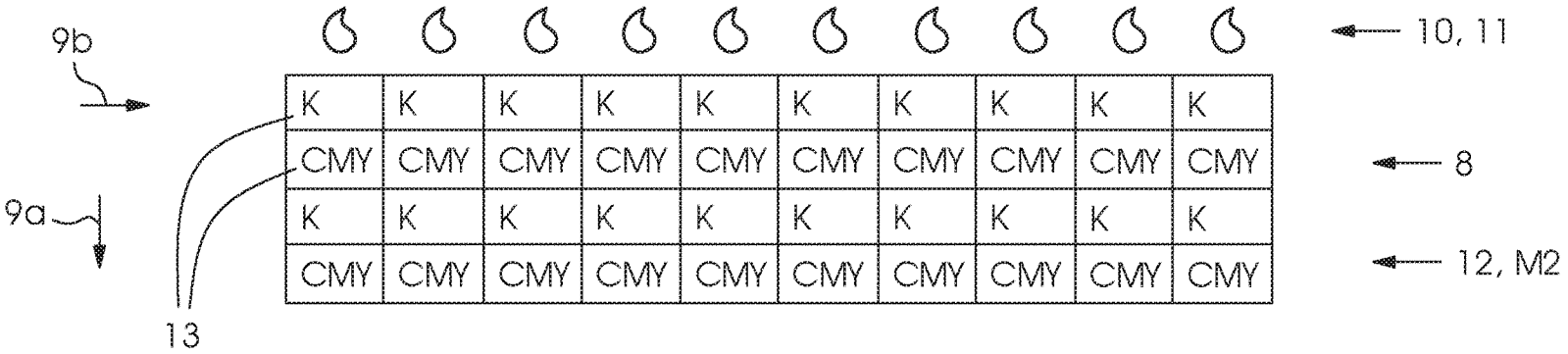
FIG. 4 is a plan view of a section of a four-color print printed in the $2^{nd}$ mode.

The following FIGS. 3A to 3C and 4 illustrate sections of prints 12 that have been printed in the second mode M2 of the method of the invention. In a way corresponding to the print of FIG. 2A, the prints 12 of FIGS. 3A to 3C are printed by a seven-color printing machine, and the print shown in FIG. 4 is printed by a four-color printing machine in a way corresponding to the print of FIG. 2B.

FIG. 3A shows that compared to the conveying speed of the embodiment of FIG. 2A, i.e. to the standard speed of the latter embodiment, the conveying speed of FIG. 3A has been increased to the fourfold, for lines of the same color, e.g. black/K, repeat every four lines, i.e. three more lines are printed in between. Thus, the length of the sheet that is printed per unit of time or in accordance with the cycle of the print heads is four times longer. For this purpose, the sheet is conveyed at an substantially fourfold conveying speed. The same applies to the embodiments shown in FIGS. 3B and 3C.

The respective reduced-color print 12 shown in FIGS. 3B and 3C is a black or black-and-white or grayscale print. The elements 13 of the respective print 12 are either black/K or a combination of OC, GM, or YV. The latter three combinations of complementary colors ideally also create black or, more realistically, a grayscale. In the context of the invention, instead of the OGV colors, it is also possible and even advantageous to use special adapted colors F1, F2, and F3 that—in the combinations F1 plus C (F1C), F2 plus M (F2M) and F3 plus Y (F3Y)—get as close as possible to black or the ideal grayscales and are as little off-color to black or the ideal grayscales as possible. Instead of orange, a red color might be used, for instance.

A comparison between FIGS. 3A to 3C shows that although the print 12 is composed of the same elements 13, they are disposed in different ways in the various embodiments, i.e. they form different "patterns." FIG. 3A shows that identical elements 13 are disposed in the rows, namely elements K, OC, GM, and VY. Such "cross-lines" may be visible to the human eye and are therefore undesired. FIG. 3B shows diagonal lines that might also be visible. FIG. 3C finally shows elements 13 that are disposed in an alternating way so that no continuous "lines" may be discerned, which means that the last embodiment is the preferred embodiment. Alternatively, a statistical configuration of the cells may be selected.

The preferred embodiment shown in FIG. 3C indicates that "on average," for instance in a field of 4 times 8 elements (4 in the lateral direction, 8 in the conveying direction), the black elements 13 and the chromatic cells located therebetween result in a grayscale value.

In order to obtain the grayscale value to be achieved at the respective location of the print in accordance with the print 12, the halftone and/or dot size are adapted in a known way at the location in question.

FIG. 4 shows that the conveying speed has been doubled compared to the standard speed of the embodiment shown in FIG. 2B: One line is printed using black K, the next line is printed using CMY, and so on. The print generated in this embodiment 12 likewise has reduced colors, in particular black or black-and-white or a grayscale print.

In the embodiments of FIGS. 3A to 3C and 4, the drop sizes 11 are different, in particular larger than in the embodiments of FIGS. 2A and 2B, i.e. in the second mode M2 they are different from the drop sizes in the first mode M1. Since only three colors are mixed to form black or gray in the embodiment of FIG. 4, the color density achievable at a small drop size may be too low.

Consequently, in this case, the use of larger drop sizes may be expedient. The following is a summary list of reference numerals and the corresponding structure used in the above description of the invention.

LIST OF REFERENCE SYMBOLS

1 inkjet printing machine
2 feeder
3 pre-coating unit
4 printing unit
4*a*-4*f* K CMY OGV printing stations
5 drier
6 varnishing unit
7 delivery
8 sheet of printing material
9*a* conveying direction/conveying speed
9*b* lateral direction
10 inks
11 ink drops/size thereof
12 print
13 elements of the printed image
14 machine control unit
M1 first mode
M2 second mode

The invention claimed is:

1. A method for alternately operating an inkjet printing machine applying a plurality of inks to a printing material in accordance with a print image, the method comprising the following steps:

conveying the printing material at a conveying speed;

operating the inkjet printing machine in a first mode or a second mode in dependence on a print job to be produced as follows:

in the first mode: printing an n-color first print job at a first conveying speed and at a print resolution using n inks including black ink and n−1 different chromatic inks;

in the second mode: printing a reduced-color second print job at a second conveying speed greater than the first conveying speed and at an identical print resolution using the n inks:

printing a black-and-white or a grayscale print job in the second mode;

printing a proportion of black or gray elements of the print by using the n−1 different chromatic inks, where n=7, K and CMY OGV inks are applied, K is black, C is cyan, M is magenta, Y is yellow, O is orange, G is green, and V is violet; and printing three quarters of the black or gray elements of the print by using OC, GM, or VY inks.

2. The method according to claim 1, wherein the second conveying speed approximately equals four times the first conveying speed.

* * * * *